US006272828B1

(12) United States Patent
Walling et al.

(10) Patent No.: US 6,272,828 B1
(45) Date of Patent: Aug. 14, 2001

(54) DOUBLE-TWISTING CABLE MACHINE AND CABLE FORMED THEREWITH

(75) Inventors: Jörg-Hein Walling, Beaconsfield; Jean-Francois Richard, Pt. Claire; Omar Saad, Kirkland, all of (CA)

(73) Assignee: Nordx/CDT, Inc., Pointe-Claire (CA)

( * ) Notice: Subject to any disclaimer, the term of this patent is extended or adjusted under 35 U.S.C. 154(b) by 0 days.

(21) Appl. No.: 09/454,947

(22) Filed: Dec. 3, 1999

Related U.S. Application Data

(60) Provisional application No. 60/110,739, filed on Dec. 3, 1998.

(51) Int. Cl.[7] ..... D01H 1/10

(52) U.S. Cl. ..... 57/58.49; 57/58.52; 57/58.54; 57/58.83

(58) Field of Search ..... 57/3, 6, 58.49, 57/58.52, 58.54, 58.83, 59, 62, 64, 293

(56) References Cited

U.S. PATENT DOCUMENTS 5,400,579 * 3/1995 Thompson ..... 57/59
5,564,268 * 10/1996 Thompson ..... 57/3
5,622,039 * 4/1997 Thompson ..... 57/3

* cited by examiner

*Primary Examiner*—John J. Calvert
*Assistant Examiner*—Shaun R Hurley
(74) *Attorney, Agent, or Firm*—Wolf, Greenfield & Sacks, P.C.

(57) ABSTRACT

A cable twisting method and apparatus, for forming double twisted pair cables. The invention longitudinally distributes the eccentricities of the individual cables, where the helical propagation of the eccentricity is not conformal to the helix formed by the geometric shape of the cables.

19 Claims, 7 Drawing Sheets

DOUBLE-TWISTING CABLE MACHINE AND CABLE FORMED THEREWITH

This application claims benefits of Provisional No. 60/110,739 filed Dec. 3, 1998.

FIELD OF THE INVENTION

The present invention relates to cable twisting machines, and more particularly, to a machine which longitudinally distributes the eccentricities of the individual cables, where the helical propagation of the eccentricity is not conformal to the helix formed by the geometric shape of the cables.

RELATED ART

High performance data cable using twisted pair transmission media have become extremely popular. Such cable constructions are comparatively easy to handle, install, terminate and use. They also are capable of meeting high performance standards.

One common type of conventional cable for high-speed data communications includes multiple twisted pairs. In each pair, the wires are twisted together in a helical fashion forming a balanced transmission line. When twisted pairs are placed in close proximity, such as in a cable, electrical energy may be transferred from one pair of the cable to another. Such energy transfer between pairs is undesirable and is referred to as crosstalk. Crosstalk causes interference to the information being transmitted through the twisted pair and can reduce the data transmission rate and can cause an increase in the bit error rate.

Crosstalk is primarily capacitively coupled or inductively coupled energy passing between adjacent twisted pairs within a cable. Among the factors that determine the amount of energy coupled between the wires in adjacent twisted pairs, the center-to-center distance between the wires in the adjacent twisted pairs is very important. The center-to-center distance is defined herein to be the distance between the center of one wire of a twisted pair to the center of another wire in an adjacent twisted pair. Crosstalk is also affected by the eccentricity of the conductors as explained below. Eccentricity refers to the departure of the shape of the insulator surrounding the conductor from a circle centered on the center of the conductor. Because it is very difficult to form the insulator around the conductor in a perfect circle, an irregular thickness of insulator may be formed about the conductor. The irregular thickness has a varying egg like shape around the conductor. This irregularity is called eccentricity.

The magnitude of both capacitively coupled and inductively coupled crosstalk varies inversely with the center-to-center distance between wires, approximately following an inverse square law. Increasing the distance between twisted pairs will thus reduce the level of crosstalk interference. Another important factor relating to the level of crosstalk is the distance over which the wires run parallel to each other. Twisted pairs that have longer parallel runs will have higher levels of crosstalk occurring between them.

Machines known in the art for forming twisted pairs of conductors are of two basic types: single-twisting and double-twisting cable machines. Single twisting machines are machines that create a single twist on the conductor for each turn of the flybar. Double-twisting machines are machines which create two twists of the conductor for each turn of the flybar. In either machine, the cable take up can be located either within the flybar or outside the flybar. If the take up is located outside the flybar, either one or both of the cable give ups can be located within the flybar. However, uniform impedance is difficult to achieve using current state of the art single-twisting or double-twisting cable machines.

Modern high performance twisting machines are mostly double twisters, which provide some predetermined amount of back torsion on each conductor. That means, that for each turn of the conductors forming the pair, the conductors themselves are torsioned by a predetermined angular rotation in the opposite direction of the twist of the cable. It has been found that a small amount of back torsioning of the conductors is sufficient to give the resulting cable a very good impedance consistency as function of frequency. However, it can be shown that upon full back torsioning no performance advantage is achieved at all in the cable.

An example of one conventional system is now described. If one of the cable give ups is located within the flybar, then the cable give up that is located outside the flybar is stationary and the conductor is fed through the flybar towards the twist forming area. In these twisters (with the exception of the single twist machine with one stationary give up outside the flybar) any eccentricity formed by the insulation over each conductor is rotated one turn per 90° of cable twist. This is shown in FIG. 1.

In these cables the cable twist direction is the same direction as the torsion twist of the individual conductors. In this configuration each conductor twists a full 360° relative to the other conductor for every 90° of cable twist. Thus, at a 45° twist of the cable, the conductors are each oriented with a 180° of twists relative to each other; this orientation of the conductors also repeats every 90°. As a result of these repeating orientations, there is a very pronounced cyclic variation in the center to center distance between the adjacent conductors which is offset by the phase angle between the different cyclic variations. This cyclic repetition of the center to center distance between the conductors influences the impedance of the cable as a function of frequency, and therefore, causes a structural return loss.

Furthermore, the overall eccentric wire is turning in the same direction as the helical center line of each conductor. Thus, the eccentricity of the cable is distributed longitudinally with the same helical pitch as the twist lay. That, combined with the variation of center-to-center distance of the conductors inside the insulation, causes structural impedance changes and increases the impedance irregularity of the cable. Both single twisting and double-twisting machines will yield these same results.

Single twisting machines, having one give up outside the flybar, and one give up inside the flybar, and having the cable take up of the twisted pairs outside the flybar, yield an improved, but not completely satisfactory, impedance consistency. This improved impedance consistency results because one conductor follows the above described twisting and the second conductor passes through the flybar without being subject to any torsion. The non-torsional wire is subject only to what is generally termed a "false twist," meaning the conductor is torsioned upon entering the flybar in one direction and is torsioned in the opposite direction as the twist formation point upon leaving the flybar.

A cable formed by this method is shown in FIG. 2. The conductor 20 is subject to the "false twist". This orientation of the cable generally yields lower center to center distance variations of the conductors inside the insulation and therefore yields smaller impedance variations. However, in the twisting machines that create these cables, the tension controls of the conductors just prior to the twist formation point are very difficult to control. This can increase the difficulty in obtaining data grade wires that have sufficient balance and sufficiently small impedance irregularities.

Other twisters have individual give ups, each of which is located inside a flybar. Each of these flybars imparts a predetermined back torsion upon each of the conductors before they enter either a single or double twisting machine. The desired level of back torsion imparted by these machines is approximately one third of the torsion which the conductors are subjected to in the subsequent twisting operation.

Because this torsion is applied to the conductor in the opposite direction that the cable is twisted, these machines are frequently and misleadingly referred to as cable twisters with "back twisting". A more properly descriptive term would be "twister with back torsion" of the conductors. FIG. 3 shows a pair of eccentric conductors where one of the conductors is back torsioned at a rate of 33.3% of the cable twist lay. This back torsion rate results in a repetitive pattern where a half cycle is completed every 540° of cable twist.

In all the figures, it has been assumed that the eccentricity of each conductor has a defined magnitude that is equal for both conductors. Additionally, it is assumed that these eccentricities are, at the start of the twisting operation, exactly 180° offset. While these are arbitrary choices made to simplify the presentation, the result of varying these assumptions is readily understood by the skilled artisan.

Additionally, it is assumed that the eccentric conductor is advanced in a helical fashion inside the assumed helix formed by the center line of the insulation. This implies that the insulation is circular in cross section. In reality, this is only the case for ideal crush extruded insulations with perfect concentricity and circular shape. In fact, for tubed fluorinated ethylene propylene (FEP) insulations, or tubed FEP skin insulation constructions, the geometry of the insulation may be better described by a conchoid. This conchoidal geometry is due to the sagging of the draw down cone during extrusion of the tube insulation. The insulation cools unevenly and therefore is not symmetric or constant over the length of the cable. This is also why the impedance irregularity increases with line speed, a result that is conventionally overcome by reducing the draw down ratio during the tubing operation.

SUMMARY OF THE INVENTION

The present invention provides for a method and apparatus for torsioning two individual conductors before combining them in a twisted pair. According to different aspects of the invention the conductors can be torsioned in similar or opposite directions and at different twist lays to minimize impedance irregularities.

According to one aspect, the invention may be embodied in apparatus for manufacturing twisted pairs of wires comprising a pre-torsioning apparatus including: first and second flybars, in a substantially balanced configuration for rotation about a first axis, the flybars having corresponding first and second ends, and the first and second flybars define a first rotational envelope; at least first and second give up reels fixedly mounted within the first rotational envelope, and the first and second give up reels being wound with at least first and second wires respectively; a first guide means for guiding the first wire from the first give up reel to the second end of the first flybar, and to the first end of the first flybar; and a second guide means for guiding the second wire from the second give up reel to the first end of the first flybar, and to the second end of the first flybar; whereby the first and second wires are pre-torsioned in substantially opposite directions. The apparatus may further comprise a twister machine receiving the pre-torsioned first and second wires and imparting a twist to the first and second pre-torsioned wires forming a twisted wire pair therefrom. The twister machine may be either a single twister machine wherein a single twist is imparted to the pre-torsioned first and second wires or may be a double twister machine wherein a double twist is imparted to the pre-torsioned first and second wires. If a double twister, the apparatus may further comprise the third and fourth flybars in a substantially balanced configuration for rotation about a second axis, the flybars having corresponding first and second ends, and the third and fourth flybars define a second rotational envelope; and guide means for guiding the first and second pre-torsioned wires from the first end of the first flybar, to a rotation means, rotating about the second axis, and to at least a first take up reel mounted and fixed within the second rotational envelope for receiving the double twisted, twisted wire pairs. In such a variation, the first and second axis can be substantially the same. Moreover, the second rotational envelope can encompass the first rotational envelope. Any of these embodiments can include a means for adjusting the amount of pre-torsion applied to the first and second wires. The means for adjustment can include varying the rate at which wire is taken from the first and second give up reels and the rotational rate of the first and second flybars.

According to another aspect, embodiments of the invention include an apparatus for manufacturing twisted pairs of wires comprising a pre-torsioning apparatus including: first and second flybars, in a substantially balanced configuration for rotation about a first axis, the flybars having corresponding first and second ends, and the first and second flybars define a first rotational envelope; first and second give up reels fixedly mounted within the first rotational envelope, the first and second give up reels being wound with at least first and second wires respectively; a first guide means for guiding the first wire from the first give up reel to the second end of the first flybar, to the first end of the first flybar; and a second guide means for guiding the second wire from the second give up reel to the first end of the first flybar, and to the second end of the first flybar; whereby the first and second wires are pre-torsioned in substantially opposite directions; a double twister machine receiving the pre-torsioned first and second wires and providing a double twist to the first and second pre-torsioned wires forming a twisted wire pair therefrom. The double twister machine further comprise: third and fourth flybars in a substantially balanced configuration for rotation about a second axis, the flybars having corresponding first and second ends, and the third and fourth flybars define a second rotational envelope; and guide means for guiding the first and second pre-torsioned wires from the first end of the first flybar to the second end of the first flybar, t a rotation means, rotating about the second axis, and to at least a first take up reel mounted and fixed within the second rotational envelope for receiving the double twisted, twisted wire pairs.

According to yet another aspect, the invention may be embodied in apparatus for manufacturing twisted pairs of wires comprising a pre-torsioning apparatus including: first and second flybars, in a substantially balanced configuration for rotation about a first axis, the flybars having corresponding first and second ends, and the first and second flybars define a first rotational envelope; first and second give up reels fixedly mounted within the first rotational envelope, the first and second give up reels being wound with at least first and second wires respectively; a first guide means for guiding the first wire from the first give up reel to the second end of the first flybar, to the first end of the first flybar; and a second guide means for guiding the second wire from the second give up reel to the first end of the first flybar, and to the second end of the first flybar; whereby the first and second wires are pre-torsioned in substantially opposite directions; a double twister machine receiving the pre-torsioned first and second wires and providing a double twist to the first and second pre-torsioned wires forming a twisted wire pair therefrom. According to this aspect, the double twister machine further comprises: third and fourth flybars in a substantially balanced configuration for rotation about a second axis, the flybars having corresponding first and second ends, and the third and fourth flybars define a second rotational envelope; and guide means for guiding the first and second pre-torsioned wires from the first end of the first flybar to the second end of the first flybar, to a rotation means, rotating about the second axis, and to at least a first take up reel mounted and fixed within the second axis, and to at least a first take up reel mounted and fixed within the second rotational envelope for receiving the double twisted, twisted wire pairs. According to yet another aspect, the invention may be embodied in a method for manufacturing double twisted pairs of wires comprising the steps of: unwinding a first wire from a first reel and a second wire from a second reel; pre-torsioning the first and second wires in substantially opposite directions; and twisting the first and second wires about each other forming a twisted pair. The step of pre-torsioning may include guiding the first and second wires to a first and second flybars rotating about a first axis; and guiding the first and second wires along the first and second flybars respectively and in opposite directions whereby a substantially opposite pre-torsion is applied to the first and second wires. There can be a further step of adjusting the pre-torsion applied to the first and second wires. The step of adjusting the pre-torsion can include the step of varying the rotational velocity of the first and second flybars and the rate at which the first and second wires are unwound from the first and second reels. The twisting step can impart a single twist. The twisting step imparts a double twist. Finally, the wires can be insulated conductors.

BRIEF DESCRIPTION OF THE DRAWINGS

In the drawings, in which like reference designations indicate like elements.

DETAILED DESCRIPTION

The present invention will be better understood upon reading the following detailed description in connection with the figures.

Figure 1:
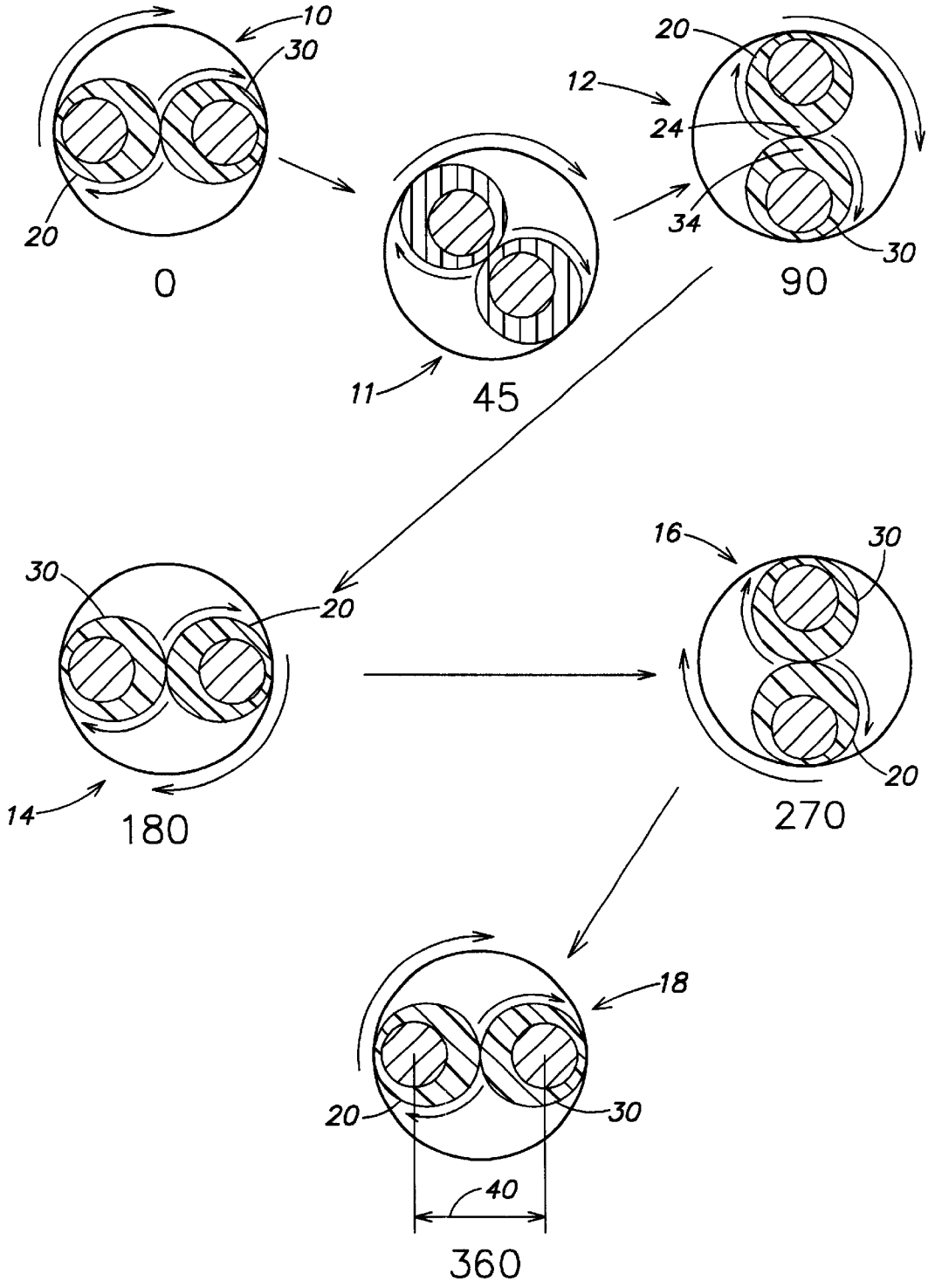
FIG. 1 (PRIOR ART)
FIG. 1 is a cross section of a twisted pair, created by twisting machines of the prior art, with both conductors pre-torsioned in the same direction.

FIG. 1 shows a cross section of a cable 10 containing individual conductors 20 and 30. The individual conductors are pre-torsioned in a manner in accordance with the prior art. The conductors are twisted together to form a twisted pair. FIG. 1 shows the cable of the twisted pair at several degrees of twist: 0° 10, 90° 12, 180° 14, 270° 16, and 360° 18.

Because of the pre-torsioned twist lay in the conductors, at every 90° twist of the cable the same parts of the conductors will be in contact. This is shown in FIG. 1. Inside the cable at 0° cable twist 10, the thick portions of the conductors insulation 24 and 34 are facing each other. Inside the cable at 90° twist 12 this is still true. For 180° 14, 270° 16 and 360° 18 it is still also true.

Because of this, the variation in center to center distance 40 of the conductors within the cable is very pronounced during each 90° twist of the cable. Starting at 0% of cable twist 10 the center to center distance 40 will be at a maximum every 90°. Starting at 45° of cable twist 11 the center to center distance 40 will be at a minimum every 90°. This variation of the center to center distance causes structural impedance changes and increases the cable impedance irregularity.

Figure 2:
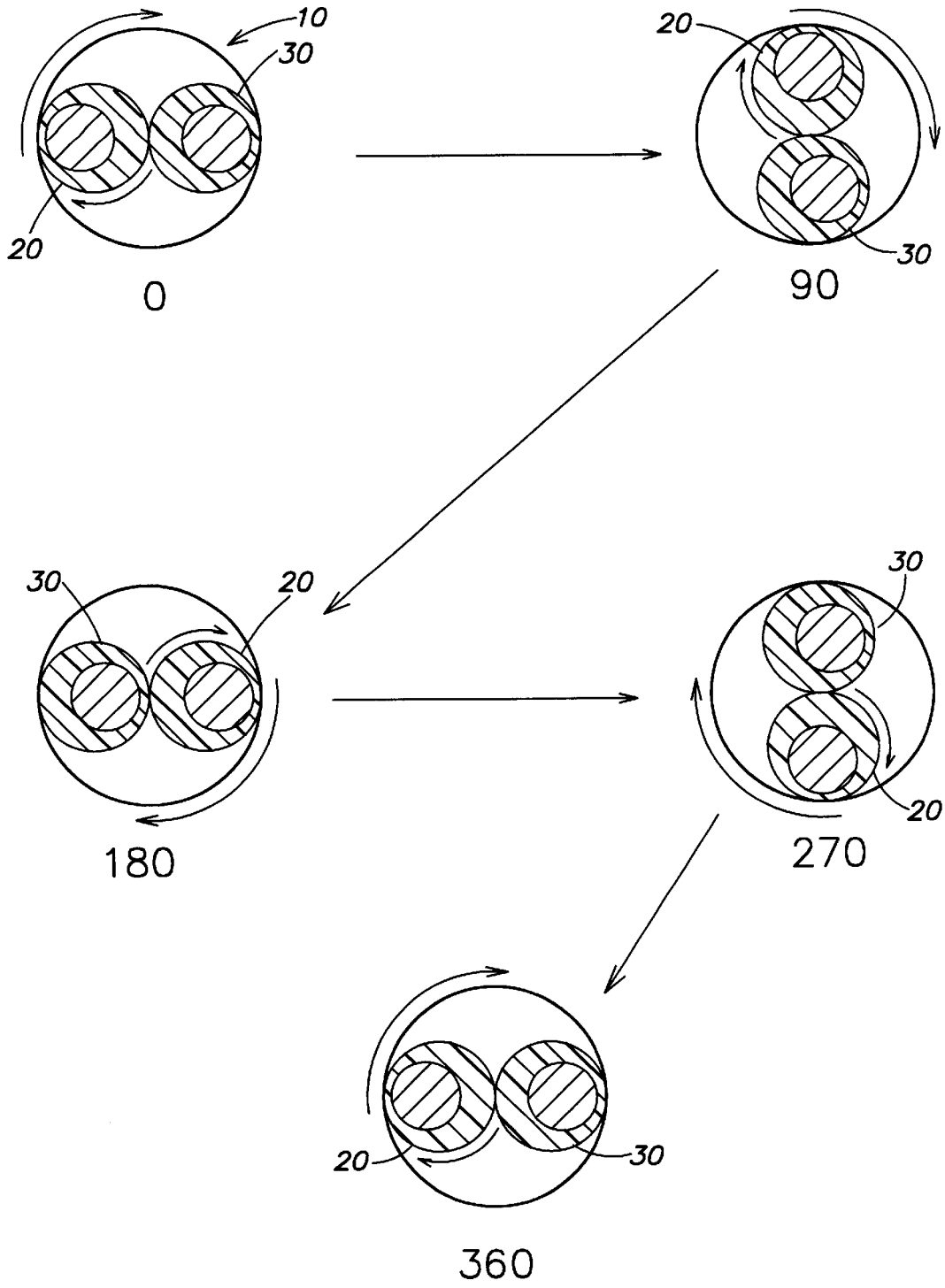
FIG. 2 (PRIOR ART)
FIG. 2 is a cross section of a twisted pair, created by twisting machines of the prior art, with one conductor pre-torsioned.

FIG. 2 shows a cross section of cable 10 with one conductor 30 pre-torsioned and one conductor 20 not pre-torsioned. This cable achieves lower center to center distance variations of the conductors inside the insulation and therefore smaller impedance variations, however, due to poor tension control these cables suffer from balance problems and other impedance irregularities.

Figure 3:
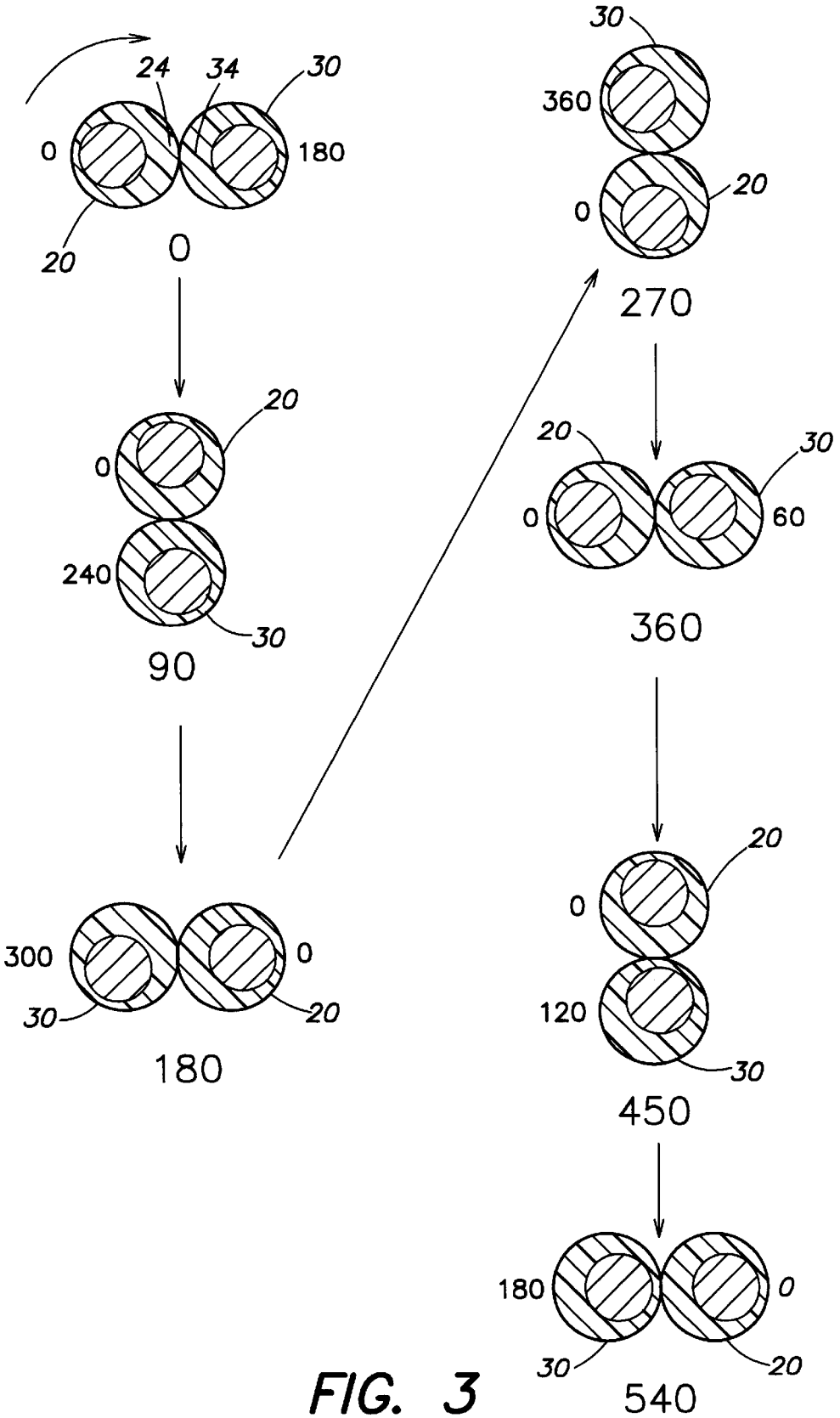
FIG. 3 (PRIOR ART)
FIG. 3 is a cross section of a twisted pair, created by twisting machines of the prior art, with one conductor pre-torsioned with a 33.3% back torsion.

FIG. 3 shows a cross section of cable 10 where one cable 30 is back torsioned by 33% of the cable twist lay and one conductor 20 is not pre-torsioned. FIG. 3 shows the twist lay forming angle for each conductor. This is the phase angle at which each conductor starts relative to the orientation of the non pre-torsioned conductor 20. Also indicated, at each interval, is the angle at which the eccentric conductors are torsioned relative to the their starting point. This angle for the back twister conductor 30 is one third of the twist lay forming angle, offset by half a twist cycle.

Figure 4:
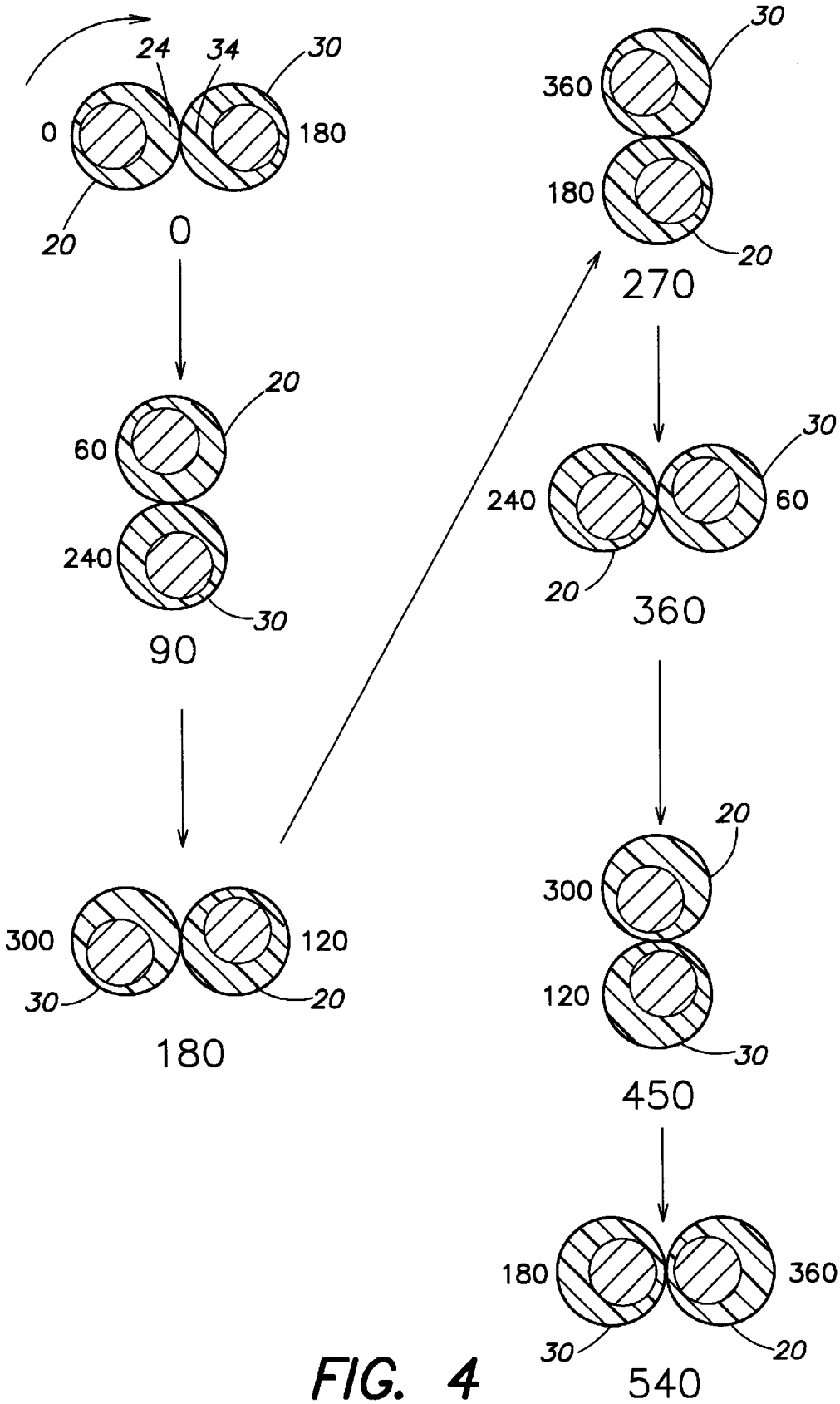
FIG. 4 (PRIOR ART)
FIG. 4 is a cross section of a twisted pair, created by twisting machines of the prior art, with each conductor twisting with a 33.3% back torsion.

FIG. 4 shows a cross section of a cable 10 where each cable 20 and 30 are back torsioned by 33.3%.

Figure 5:
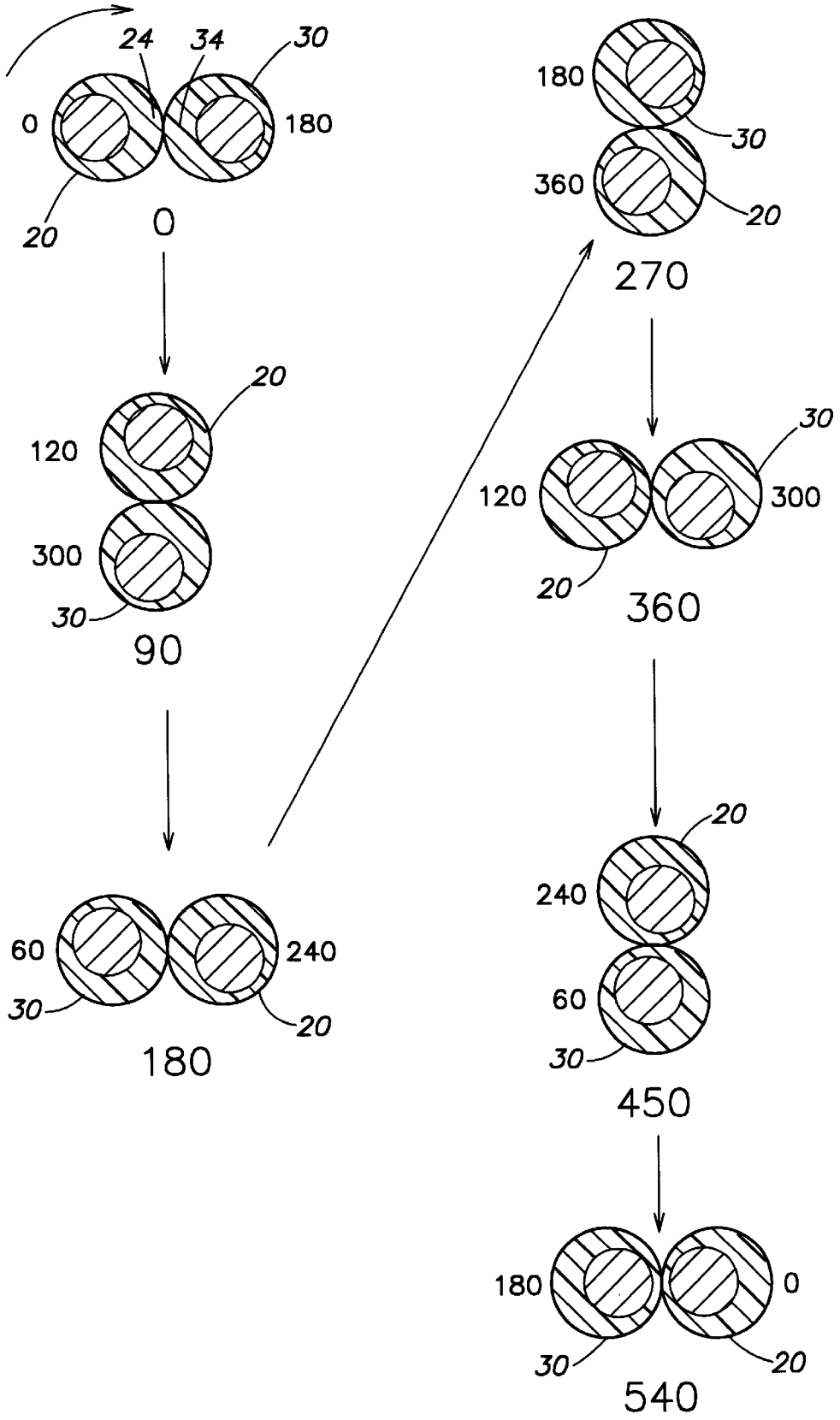
FIG. 5 is a cross section of a twisted pair, created by twisting machines of the invention, with each conductor twisting with a 33.3% forward torsion.

FIG. 5 shows a cable of the invention where, instead of the conductors being back torsioned at 33.3% in the opposite direction of the cable twist as shown in FIG. 4 and described above, the conductors are forward torsioned at 33.3% in the same direction as the same direction of the cable twist. It can be seen that in the resulting geometry, the only difference between back and forward torsioning by 33% is that the eccentricity of the conductors are positioned like mirror images. The electrical performance of twisted pairs made with both methods of pre-torsioning of the conductors show little difference. However, the crosstalk performance of twisted pairs made with these two methods is slightly affected. This is due to the electromagnetic field emanating from the conductors vertical to the center line between both conductors differently inclined, and thus yields different crosstalk. If we forward torsion only one of the conductors, then we obtain the same result as for a twist machine with a single conductor give up inside the flybar, but mirror imaged relative to a pair produced with back torsion on one conductor. Also, in this double forward torsioning embodiment, a surface defined between the center lines of both conductors is inclined relative to a surface defined between the center lines of the insulations. This will also impact upon the cross talk.

Figure 6:
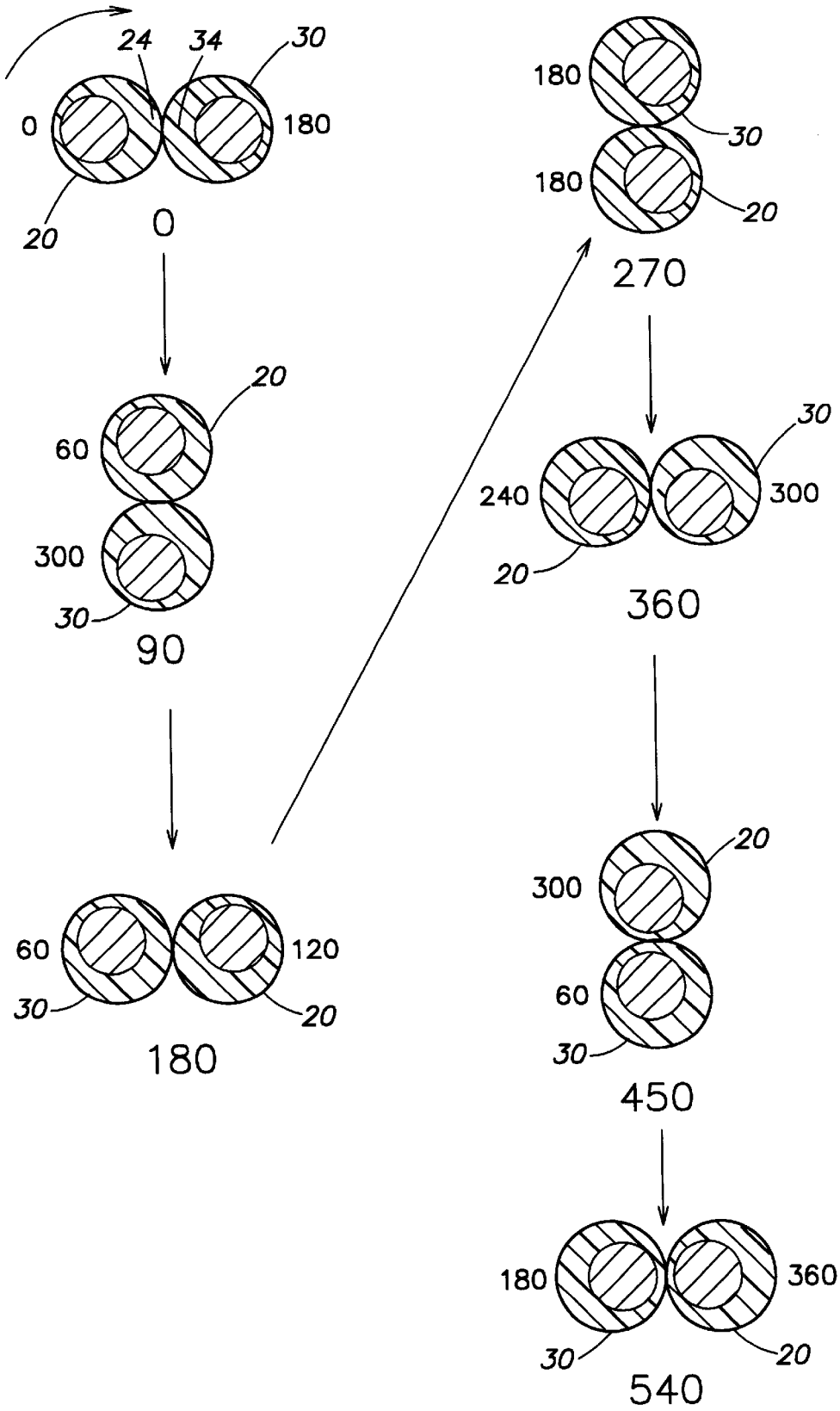
FIG. 6 is a cross section of a twisted pair, created by twisting machines of the invention, with one conductor twisting with a 33.3% back torsion and the other twisting with a 33.3% forward torsion.

In another embodiment, both conductors are torsioned in opposite directions prior to twisting. This embodiment, shown in FIG. 6, produces an eccentricity cycle equal to half a twist cycle. Here, the surface defined between the centers of the conductors and that defined between the centers of the insulation remain parallel to each other. Therefore, in this embodiment, there is only a small effect upon the crosstalk performance between the adjacent pairs. This means that the crosstalk performance is determined by the cable twist lay and is not impacted by the back and forward torsioning.

Figure 7:
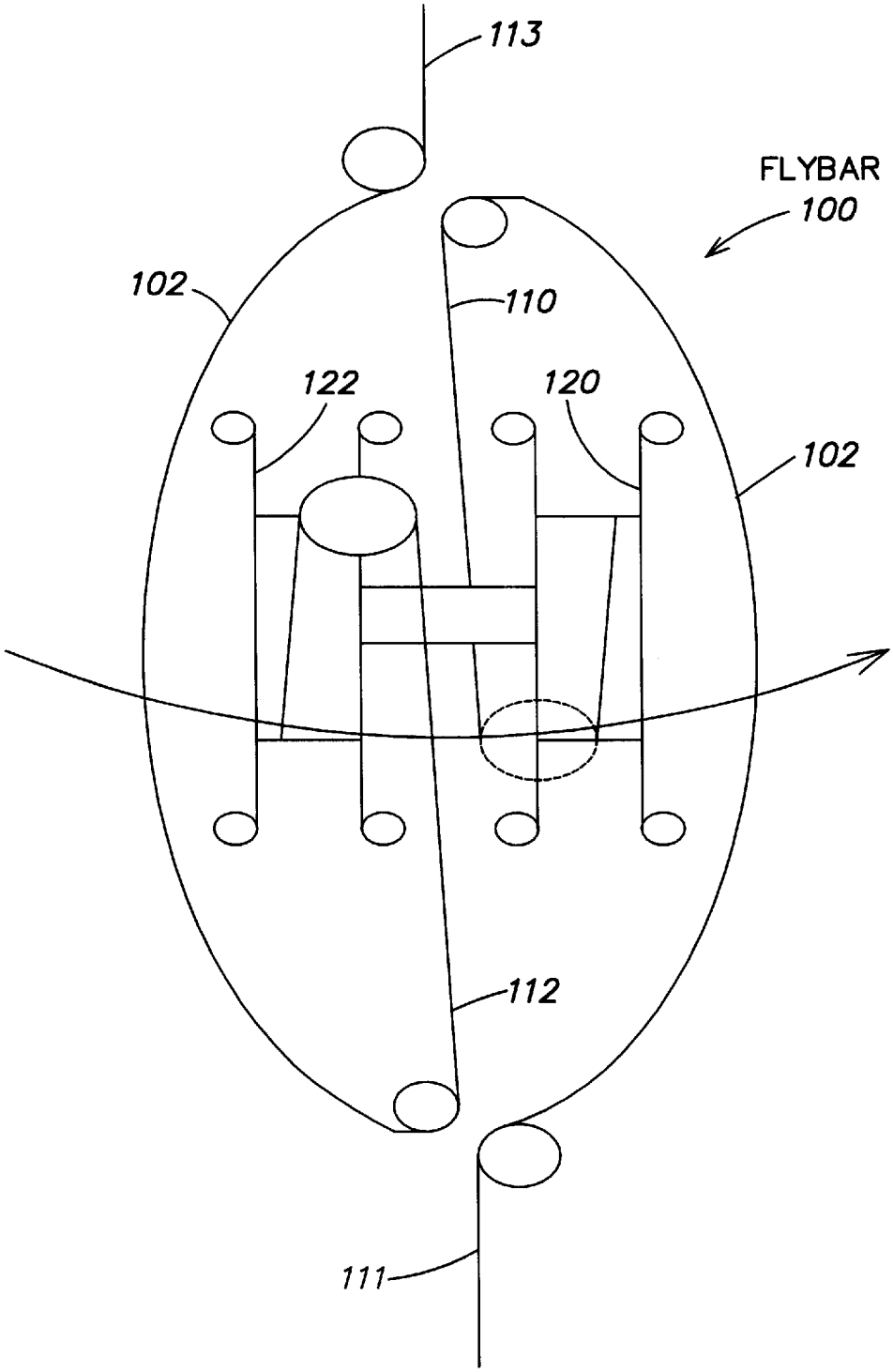
FIG. 7 shows a flybar arrangement for a twisting machine for a simultaneous backward and forward torsion.

The cable configuration including back torsioning one conductor and forward torsioning another conductor is advantageous since both forward and back torsioning can be performed with the same flybar. In one embodiment, shown in FIG. 7, a double torsioning flybar 100 is used, having two give ups 120, 122 within the flybar 102 envelope. The wires 110, 112 are guided such that each wire enters one side of the flybar 102 close to the opposing ends where the flybars 102 are attached to the bearings. Thus, the wires 111, 113 leaving the flybar 100 at the opposite bearings of the rotating flybars 102 are subjected to opposite torsions, i.e., two turns for each turn of the flybar 100. In one embodiment, these oppositely pre-torsioned wires 111, 113 are provided to a double twister (not shown) and are formed with the desired twist pattern.

The machine as described is very economical compared to regular back torsion machines because there are only two flybars required. Furthermore, both the forward and back torsioning flybar 100 and the twisting machine should be driven by the same motor so that the back and forward torsion is always directly proportional to each selected twist lay, and is solely dependent upon a preselected ratio which may be fixed by a gear or pulley ratio.

As described above, FIG. 7 shows a flybar arrangement 100 for a simultaneous back and forward torsion machine. In this embodiment two wires 110 and 112 are pulled from stationary give ups 120 and 122 within the flybar 102 and are provided with opposite torsion. The degree of torsion is determined by the combination of pull off speed and the speed of rotation of the flybar.

The arrangement of the double twister is straight forward and well known in the art, a double twist flybar with an internal takeout would be commonly used. Such a machine is characterized as having two flybar arrangements. Between the back and forward torsioner and the double twister there can be provided some sort of help or capstan. The help or capstan can be used to equalize the tension between both wires upon entering the double twister. For high electrical performances, it is advisable to provide the master for the entire torsioner twister group capstan within the double twister flybar.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto.

What is claimed is:

1. An apparatus for manufacturing twisted pairs of wires comprising:

a pre-torsioning apparatus including:

first and second flybars, in a substantially balanced configuration for rotation about a first axis, the flybars having corresponding first and second ends, and the first and second flybars define a first rotational envelope;

at least first and second give up reels fixedly mounted within the first rotational envelope, and the first and second give up reels being wound with at least first and second wires respectively;

a first guide means for guiding the first wire from the first give up reel to the second end of the first flybar, and to the first end of the first flybar; and a second guide means for guiding the second wire from the second give up reel to the first end of the first flybar, and to the second end of the first flybar;

whereby the first and second wires are pre-torsioned in substantially opposite directions.

2. The apparatus as in claim 1 further comprising a twister machine receiving the pre-torsioned first and second wires and imparting a twist to the first and second pre-torsioned wires forming a twisted wire pair therefrom.

3. The apparatus as in claim 2 wherein the twister machine is a single twister machine wherein a single twist is imparted to the pre-torsioned first and second wires.

4. The apparatus as in claim 2 wherein the twister machine is a double twister machine wherein a double twist is imparted to the pre-torsioned first and second wires.

5. The apparatus as in claim 4 wherein the double twister machine further comprises:

the third and fourth flybars in a substantially balanced configuration for rotation about a second axis, the flybars having corresponding first and second ends, and the third and fourth flybars define a second rotational envelope;

guide means for guiding the first and second pre-torsioned wires from the first end of the first flybar, to a rotation means, rotating about the second axis, and to at least a first take up reel mounted and fixed within the second rotational envelope for receiving the double twisted, twisted wire pairs.

6. The apparatus as in claim 5 wherein the first and second axis are substantially the same.

7. The apparatus as in claim 6 wherein the second rotational envelope encompasses the first rotational envelope.

8. The apparatus as in claim 1 further comprising a means for adjusting the amount of pre-torsion applied to the first and second wires.

9. The apparatus as in claim 8 wherein the means for adjustment includes varying the rate at which wire is taken from the first and second give up reels and the rotational rate of the first and second flybars.

10. An apparatus for manufacturing twisted pairs of wires comprising:

a pre-torsioning apparatus including:

first and second flybars, in a substantially balanced configuration for rotation about a first axis, the flybars having corresponding first and second ends, and the first and second flybars define a first rotational envelope;

first and second give up reels fixedly mounted within the first rotational envelope, the first and second give up reels being wound with at least first and second wires respectively;

a first guide means for guiding the first wire from the first give up reel to the second end of the first flybar, to the first end of the first flybar; and a second guide means for guiding the second wire from the second give up reel to the first end of the first flybar, and to the second end of the first flybar;

whereby the first and second wires are pre-torsioned in substantially opposite directions;

a double twister machine receiving the pre-torsioned first and second wires and providing a double twist to the first and second pre-torsioned wires forming a twisted wire pair therefrom.

11. The apparatus as in claim 10 wherein the double twister machine further comprises:

third and fourth flybars in a substantially balanced configuration for rotation about a second axis, the flybars having corresponding first and second ends, and the third and fourth flybars define a second rotational envelope; and guide means for guiding the first and second pre-torsioned wires from the first end of the first flybar to the second end of the first flybar, t a rotation means, rotating about the second axis, and to at least a first take up reel mounted and fixed within the second rotational envelope for receiving the double twisted, twisted wire pairs.

12. An apparatus for manufacturing twisted pairs of wires comprising:

a pre-torsioning apparatus including:

first and second flybars, in a substantially balanced configuration for rotation about a first axis, the flybars having corresponding first and second ends, and the first and second flybars define a first rotational envelope;

first and second give up reels fixedly mounted within the first rotational envelope, the first and second give up reels being wound with at least first and second wires respectively;

a first guide means for guiding the first wire from the first give up reel to the second end of the first flybar, to the first end of the first flybar; and a second guide means for guiding the second wire from the second give up reel to the first end of the first flybar, and to the second end of the first flybar;

whereby the first and second wires are pre-torsioned in substantially opposite directions;

a double twister machine receiving the pre-torsioned first and second wires and providing a double twist to the first and second pre-torsioned wires forming a twisted wire pair therefrom;

wherein the double twister machine further comprises:

third and fourth flybars in a substantially balanced configuration for rotation about a second axis, the flybars having corresponding first and second ends, and the third and fourth flybars define a second rotational envelope; and guide means for guiding the first and second pre-torsioned wires from the first end of the first flybar to the second end of the first flybar, to a rotation means, rotating about the second axis, and to at least a first take up reel mounted and fixed within the second axis, and to at least a first take up reel mounted and fixed within the second rotational envelope for receiving the double twisted, twisted wire pairs.

13. A method for manufacturing double twisted pairs of wires comprising the steps of:

unwinding a first wire from a first reel and a second wire from a second reel;

pre-torsioning the first and second wires in substantially opposite directions;

twisting the first and second wires about each other forming a twisted pair.

14. The method of claim 13 wherein the step of pre-torsioning includes:

guiding the first and second wires to first and second flybars rotating about a first axis;

guiding the first and second wires along the first and second flybars respectively and in opposite directions whereby a substantially opposite pre-torsion is applied to the first and second wires.

15. The method of claim 13 further comprising the step of adjusting the pre-torsion applied to the first and second wires.

16. The method of claim 15 wherein the step of adjusting the pre-torsion includes the step of varying the rotational velocity of the first and second flybars and the rate at which the first and second wires are unwound from the first and second reels.

17. The method of claim 13 wherein the twisting step imparts a single twist.

18. The method of claim 13 wherein the twisting step imparts a double twist.

19. The method of claim 13 wherein the wires are insulated conductors.

* * * * *